United States Patent [19]

Greenhouse

[11] Patent Number: 4,750,695

[45] Date of Patent: Jun. 14, 1988

[54] REFUSE BAG HOLDER

[75] Inventor: Margaux A. Greenhouse, Toronto, Canada

[73] Assignee: Zyton Inc., Toronto, Canada

[21] Appl. No.: 49,837

[22] Filed: May 15, 1987

[51] Int. Cl.[4] ..... B65B 67/04

[52] U.S. Cl. ..... 248/99; 141/391

[58] Field of Search ..... 248/95, 97, 99, 100, 248/101, 311.2; 220/404; 53/390; 141/314, 391, 108

[56] References Cited

U.S. PATENT DOCUMENTS

| | | | |
|---|---|---|---|
| 373,199 | 11/1887 | Schedin | 248/99 |
| 566,809 | 9/1896 | Strong | 248/99 X |
| 2,754,076 | 7/1956 | Westervelt | 248/100 X |
| 3,684,225 | 8/1972 | Crawford | 248/99 |
| 4,445,658 | 5/1984 | Ferron | 248/100 X |
| 4,620,681 | 11/1986 | Staley | 248/95 |
| 4,638,968 | 1/1987 | Auten | 248/100 X |

FOREIGN PATENT DOCUMENTS

| | | | |
|---|---|---|---|
| 801666 | 9/1958 | United Kingdom | 248/99 |

*Primary Examiner*—J. Franklin Foss

*Attorney, Agent, or Firm*—George A. Rolston

[57] ABSTRACT

A bag holder to hold a plastic bag with an open mouth and handles and having two side members, dimensioned to accommodate a bag with handles, a top rim on each said side member over which said open mouth of said plastic bag can be folded, tongues on each of said side members located below the plane of the top rims and on which handles of said bag may be attached; and, mounting means for mounting the side members on a support.

2 Claims, 1 Drawing Sheet

REFUSE BAG HOLDER

The invention relates to a bag holder for holding a bag such as a refuse bag and, in particular, for holding a shopping bag having handles.

BACKGROUND OF THE INVENTION

Various different holders are available for holding platsic bags for the collection of material, such as refuse bags. Some holders are formed in the shape of buckets of injection moulded plastic. Others are formed as wire baskets. In most cases, however, they are designed to hold a plastic refuse bag of a particular shape and size. The user must buy a supply of the bags in order to dispose of refuse.

A part of the refuse which may be disposed of in this way will consist of grocery containers, such as conventional plastic shopping bags. In many cases, consumers will attempt to use the plastic shopping bags themselves as refuse bags. However, the baskets or holders which are currently on the market are not designed for use with conventional plastic shopping bags. As a result if a plastic shopping bag is used, it often becomes dislodged or loose, and falls out of the basket or holder, and refuse is then ejected onto the floor.

BRIEF SUMMARY OF THE INVENTION

The invention seeks to overcome the foregoing problems by the provision of a bag holder for a plastic bag with handles, such holder consisting of two side members, to support the sides of a bag, the side portions being so dimensioned as to accommodate the typical plastic bag with handles, and defining a top rim, over which the bag can be stretched, and there being a downwardly directed hook portion on each of the side members, located below the level of said top rim, over which the handles of the bag may be attached.

More particularly, the invention seeks to provide a bag holder having the foregoing advantages wherein the two side members are separate from one another, and including mounting means on each said side member whereby the same may be attached to a support.

More particularly, it is an objective of the invention to provide a bag holder having the foregoing advantages wherein said side members define upper and lower edges, and there being mounting means on one end of both said side members, the other ends being free, and said side members being adapted to be spaced apart from one another, thereby defining an opening between said free ends at the front thereof.

More particularly, it is an objective of the invention to provide a bag holder having the foregoing advantages, which is particularly adapted to be manufactured by injection moulding techniques out of suitable thermoplastic materials.

More particularly, the invention seeks to provide a bag holder having the foregoing advantages and wherein said side portions include end portions at said free ends of said side members, said end portions being angled relative to said side members, so as to be directed towards one another and lying in a common plane, and mounting brackets on said side members, angled relative to said side members and lying on a common plane with one another, for mounting on a flat surface.

More particularly, it is an objective of the invention to provide a bag holder having the foregoing advantages wherein said mounting brackets define upper edge flange portions, said upper edge flange portions being offset relative to said mounting brackets, whereby to lie in a plane spaced apart therefrom, and defining channels for reception of the edge of a said bag.

More particularly, it is an objective of the invention to provide a bag holder having the foregoing advantages and including retaining rib means on said end portions, extending around an arc, whereby to provide further retention for the edge of a said bag.

More particularly, it is an objective of the invention to provide a bag holder having the foregoing advantages wherein said hook portions extend downwardly from said lower edges of said side members, and include engagement means for engaging the handles of a said plastic bag.

The various features of novelty which charcterise the invention are pointed out with more particularity in the claims annexed to and forming a part of this disclosure. For a better understanding of the invention, its operating advantages and specific objects attained by its use, reference should be had to the accompanying drawings and descriptive matter in which there are illustrated and described preferred embodiments of the invention.

IN THE DRAWINGS

DESCRIPTION OF A SPECIFIC EMBODIMENT

Figure 1:
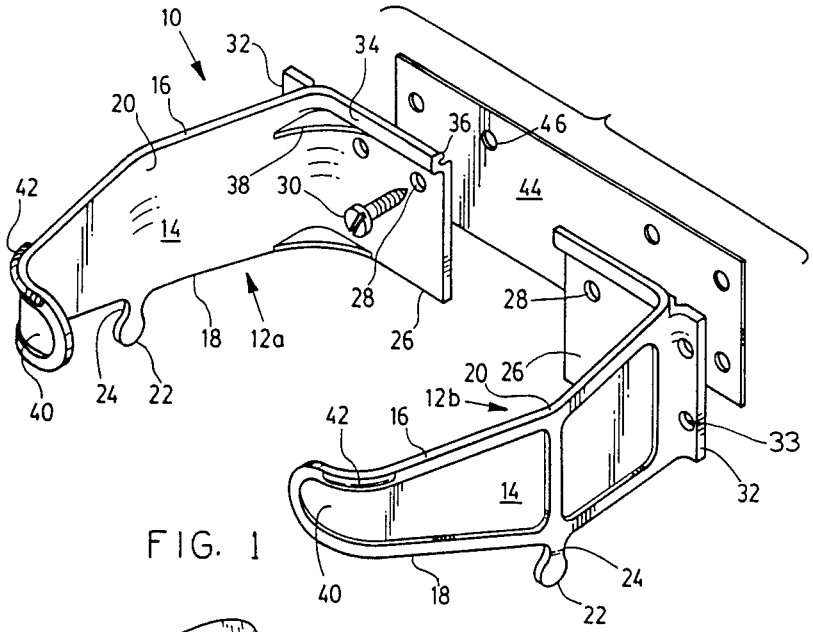
FIG. 1 is a perspective illustration of a bag holder in accordance with the invention.

Referring now to the drawings, it will be seen that the invention is illustrated in the form of a bag holder 10 made of injection moulded thermoplastic which is particularly adapted to be mounted on a vertical support such as a wall, typically being the door of a kitchen cabinet. Obviously, however, the invention is not limited to use only in connection with kitchen cabinets but may also be of use in workrooms, basements, bathrooms and the like, or any location where refuse may accumulate.

The bag holder may also be used for holding bags with handles in any other application, and is not restricted to the collection of refuse.

As shown in FIG. 1, the bag holder 10 according to the invention comprises two side members **12*a* and 12*b*** which in this embodiment are left and right handed but are otherwise identical. As will be apparent from the following description this has certain advantages, although the invention is not exclusively limited to such of form of side members.

Each of the side members **12*a* and 12*b* in this embodiment comprises a side portion 14, having upper and lower edges 16 and 18 respectively, and preferably being formed around an arc, or with a slight bend midway along its length, indicated as 20**.

The upper edge 16 is adapted to lie more or less horizontal, and the lower edge 18 is located at an angle relative to upper edge 16. More or less midway along the length of the side members 14—14, a hook or tongue 22 extends downwardly, in this embodiment being rooted on the lower edge 18. The tongue 22 is formed with a narrow waist 24 for reasons to be described below.

Mounting means for mounting the side members **12*a*–12*b* are provided which, in this case, comprise the generally flat planar mounting brackets 26—26, which are turned inwardly relative to each of the side members 12a–12b so as to lie in a common plane, when mounted. Typically brackets 26 will be provided with holes 28 for receiving screws 30**.

An outer bracing flange 32—32 is formed on each of the side members 14—14 in the same plane as the mounting brackets 26, but extending in the opposite direction, i.e., "outwardly" for further resisting downward stresses applied to the side members.

Screw holes 33 may be formed in flanges 32 if desired.

Along the upper edge of each of the mounting brackets 26, retaining flanges 34 are formed, preferably defining along their upper edges retaining ribs 36.

Flanges 34 lie in a plane offset from the plane of their respective brackets 26, to define a channel.

Corner gussets 38 are formed at the junction between mounting brackets 26 and side members 14 for greater strength.

At the forward or free ends of the side members 12a–12b, end arms 40—40 are formed, which consist essentially of endwise extensions of the side members turned at an angle thereto and directed towards one another. The end arms 40 define retaining ridges 42 for reasons to be described below extending around an outside arc of corner.

Preferably, the upper and lower edges 16 and 18 will be formed of thermoplastic material of increased thickness, and the main portion of the side members will be formed of material of somewhat reduced thickness, thereby achieving maximum strength, while minimizing the material content.

A rear spacer plate 44 may be provided for assistance in mounting, which may be of any suitable thin material, formed either with holes 46, or simply scribed so as to indicate the location for the insertion of the screws 30 (33).

Figure 3:
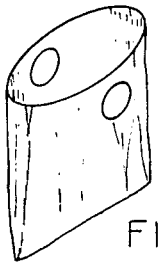
FIG. 3 is a drawing of a typical plastic shopping bag on a reduced scale.
Figure 2:
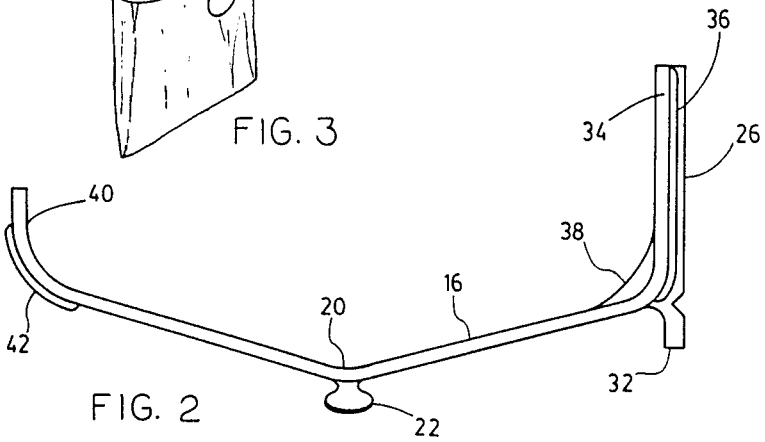
FIG. 2 is a top plan view of one side of the bag holder of FIG. 1.

A typical plastic shopping bag is indicated generally as B in FIG. 3, and has two conventional handles H thereon, this being illustrated merely for the sake of clarity of description, since it is a conventional everyday product.

In operation, the side members 12a–12b are mounted, for example, on the inner side of the door of a kitchen cabinet, at a suitable elevation, and being spaced apart a distance adequate to receive therebetween a plastic shopping bag. Typically, where the side members are in the region of 6 to 8 inches long, such a distance will be in the region of 8 to 10 inches.

The spacing may vary depending upon the type of bag with which it is to be used.

A typical plastic shopping bag with handles is then introduced between the opening defined by the two end arms 40—40. The handles of the shopping bag are then folded outwardly over the top edges 16—16, and are then hooked around the tongues 22—22. The open mouth of the shopping bag is hooked around the flanges 34—34 on the mounting brackets 26—26, and is also hooked around the ridges 42—42 on the end arms 40—40.

The shopping bag will then be supported by the two handles, with the mouth held open to receive trash, or to collect any other material, while the remainer of the bag hangs downwardly.

As soon as any material is placed in the bag, the weight of the material will hold the bag in position, until it is about half or three parts full. The two handles are then simply removed and disengaged from the tongues 22 and tied together, so that the material can be disposed of or handled in any way.

While it is well known that plastic shopping bags vary in size, the great majority of the bags vary within a reasonable range, so that in practice the refuse bag holder according to the invention will be found to be capable of accommodating the great majority of plastic shopping bags with handles.

In this way it is no longer necessary for the user to purchase special refuse bags for refuse disposal. The plastic shopping bags provide a useful function, thereby saving money, storage space, and the need for manufacturing, and then disposing of, further specially designed refuse bags.

The provision of the flanges 34 and the ribs 36 and 42, and the provision of the slight bend or angling 20 in the side members all cooperate to ensure that the mouth of the shopping bag is held open, so that material can be readily placed into the shopping bag.

The gussets 38 and the bracing flanges 32 cooperate to assist in providing rigidity and strength to the side members, sufficient to support the weight of a typical shopping bag, containing a normal amount of a variety of different kinds of material.

The waists 24 on the tongue 22 are provided so as to ensure that when the shopping bag is first of all inserted and attached in position, the handles of the shopping bag do not slip off the tongues 22.

It will, of course, be apparent that, if for some reason, a user should wish to do so he may make use of four of the side members 12a–12b. Two of the side members may be mounted in the manner shown in FIG. 1, and a further two may be mounted at a distance below the first pair of side members, so that they lie horizontally side by side. In this way they will provide an upwardly-facing support surface, for supporting the bottom of a shopping bag. The end arms 40, in this position, are turned so that they are more or less vertically oriented upwardly, and will then assist in retaining the bottom of the shopping bag when, for example, a cabinet door is swung to and fro.

It will, of course, be appreciated that if desired some form of hinged lid may be provided (not shown) so as to close off the open mouth of the bag, for aesthetic reasons.

The foregoing is a description of a preferred embodiment of the invention which is given here by way of example only. The invention is not to be taken as limited to any of the specific features as described, but comprehends all such variations thereof as come within the scope of the appended claims.

What is claimed is:

1. A bag holder adapted to hold a plastic bag with an open mouth and handles and for use in filling such a bag and comprising:

two side members, said side members being to dimensioned as to accommodate therebetween a said plastic bag with handles of predetermined height defining upper and lower edges spaced apart from one another with said upper edge adapted to lie in a horizontal plane and said lower edge being angled relative thereto;

a top rim defined by said upper edge of each side member over which said open mouth of said plastic bag can be folded, said top rims lying in a common plane;

downwardly extending tongue means on the lower edge of each of said members located below the plane of said top rims on which said handles of said bag may be attached;

a mounting bracket of predetermined height formed integrally with each said side member and angled relative to said side member whereby said mounting brackets lie in common plane when attached spaced apart from one another on a support;

each said mounting bracket defining an integral upper edge flange forming an endwise continuous extension of said top edge of a respective said side member, said upper edge flange lying in a vertical plane offset from the plane of said mounting bracket whereby to define a space between said upper edge flange and a said support, and, a free end portion integral with each said side member remote from said mounting bracket, and angled relative to said side member whereby said free end portions lie in a common plane and are directed towards one another, and define an opening therebetween for insertion and removal of a said bag.

said upper and lower edges defining a height substantially equal to said height of said mounting brackets, at the junction therebetween, and, defining a reduced height adjacent said free ends.

2. A bag holder as claimed in claim 1 and including an outwardly directed retaining rib on each said free end portion, extending around an arc, whereby to provide further retention for the edge of a said bag.

* * * * *